US005169006A

United States Patent [19]

Stelzer

[11] Patent Number: 5,169,006

[45] Date of Patent: Dec. 8, 1992

[54] CONTINUOUS MAGNETIC SEPARATOR

[76] Inventor: Ceil Stelzer, 606 S. Front St., Philadelphia, Pa. 19147

[21] Appl. No.: 791,648

[22] Filed: Nov. 14, 1991

[51] Int. Cl.[5] ..... B03C 1/00

[52] U.S. Cl. ..... 209/223.1; 209/232

[58] Field of Search ..... 209/223.1, 227, 232; 210/222

[56] References Cited

U.S. PATENT DOCUMENTS

| | | | |
|---|---|---|---|
| 360,842 | 4/1887 | Atkins | 210/222 |
| 3,318,447 | 5/1967 | Ellingboe et al. | 209/223.1 |
| 3,676,337 | 7/1972 | Kolm | 210/42 |
| 4,251,815 | 4/1981 | Kelland | 209/213 |
| 4,299,701 | 11/1981 | Garrett et al. | 210/222 |
| 4,706,818 | 11/1987 | Zutell et al. | 209/223.1 |
| 4,816,143 | 5/1989 | Vollmar | 209/212 |
| 5,055,190 | 10/1991 | Hayes et al. | 210/222 |

FOREIGN PATENT DOCUMENTS

| | | | |
|---|---|---|---|
| 2444578 | 4/1976 | Fed. Rep. of Germany | 209/232 |

*Primary Examiner*—H. Grant Skaggs

[57] ABSTRACT

A continuous magnetic separator, which allows separation of fluid streams containing materials of a wide range of susceptibilities by employing high magnetic gradients distributed in a non-random repetitive pattern throughout the 3 dimensional space inside an elongate non magnetic outer housing which contains the fluid stream. The high magnetic gradients are produced by a multiplicity of small cross sectional area rods, which are a combination of alternating regions of ferromagnetic and non ferromagnetic materials which produce distortions of a magnetic field applied through the non magnetic housing, and produce channels of high gradient field which diverge from the fluid stream direction toward pairs of non magnetic partitions located with openings in the fluid stream flow which form a plenum to divert the flow of higher susceptibility fluid streams away from the main fluid stream.

23 Claims, 6 Drawing Sheets

CONTINUOUS MAGNETIC SEPARATOR

BACKGROUND OF THE INVENTION

1. Field of the Invention

The present invention relates to a magnetic separator which continuously concentrates magnetic materials from a gas or liquid which contains a mixture of magnetic materials or magnetic and non magnetic materials.

2. Prior Art

Many previously patented magnetic separators have been designed to remove impurities from an ore slurry or a process fluid or a food process or to remove a useful mineral or compound or element which is more valuable if concentrated. Those separators are either of the intermittent type, which must be periodically flushed, or the continuous type.

Three types of magnetic materials are ferromagnetic, paramagnetic and diamagnetic. Ferromagnetic materials have large positive susceptibilities. Paramagnetic materials have susceptibilities which are slightly positive and diamagnetic materials have slightly negative susceptibilities. A vacuum has zero susceptibility.

The magnitude of the force which can be exerted on a magnetic material is dependent upon a) its induced magnetization, which is proportional to its magnetic susceptibility and the magnetic field, b) the gradient of the magnetic field or the change in magnetic field strength with respect to position in the magnetic field, and c) magnetic material size.

Because magnetic susceptibilities vary from thousands of e m u (electromagnetic units) positive for ferromagnetic materials to slightly positive for paramagnetic materials and slightly negative for diamagnetic materials, the forces which can be exerted vary greatly. Therefore prior art designs vary depending upon the magnetic material to be separated.

The most difficult magnetic materials to separate are the paramagnetic and diamagnetic materials, because the forces are much smaller than with ferromagnetic materials for a given magnetic field.

Prior art designs to separate paramagnetic and diamagnetic materials have increased the magnetic field strength and the magnetic field gradient to increase the forces on those materials. The Kolm-type separator, see U.S. Pat. No. 3,676,337, employs a fibrous matrix of ferromagnetic wool placed in a high d.c. magnetic field. The random orientation of the fibers and the high magnetic field saturates the ferromagnetic fibers and certain regions within the matrix produce very high magnetic gradients. Those regions of high magnetic gradients are produced randomly throughout the matrix. The material to be separated is passed through the fiber matrix and the paramagnetic materials are attracted to the high gradient areas and embed themselves in those areas. Eventually the magnetic field must be turned off and the matrix flushed to remove the paramagnetic materials.

To overcome the requirement of periodically flushing the matrix, several continuous operation magnetic separators have been proposed.

Kelland in U.S. Pat. No. 4,261,815 discloses a separator apparatus in which a grid of fine ferromagnetic wires are arranged parallel to the flow of the fluid to be separated and a strong magnetic field is produced perpendicular to the wires and the flow. The wires distort the magnetic field and result in a magnetic gradient around the wires which concentrates magnetic materials on opposite sides along each wires axis. As the wires near the end of the magnetic field there is a grid matrix for separation of the flows from each wire. This results in the need for small openings for each wire, which can become clogged and are difficult to fabricate.

Vollmar in U.S. Pat. No. 4,816,143 discloses a method and apparatus for continuous separation of paramagnetic and/or diamagnetic particles from a flowing fluid by guiding the fluid through a multiplicity of openings which subject the fluid to a magnetic gradient produced by ferromagnetic pole element orifices. Separation is achieved when the magnetic materials of different susceptibilities flow into the opening in the orifice or away from the opening. Means are provided to deliver the fluid to the openings, and to separate the flows of the materials with different susceptibilities. There are a multiplicity of openings and orifices in a separation canister but the fluid passes through a feed opening only once in each canister and is then diverted to either the higher or lower susceptibility outlet. In order to achieve higher separations the canisters must be cascaded, with each outlet flow becoming a homogeneous mixture because of the natural mixing which takes place as the fluids travel through the channels or piping between separation orifices.

SUMMARY OF THE INVENTION

An object of the present invention is to provide a new and improved magnetic separator to separate materials of different magnetic susceptibilities over a wider range of susceptibilities by employing high magnetic gradients distributed in a non-random repetitive pattern throughout the 3 dimensional space within the separator. In the preferred embodiment of the invention said gradients are produced by a multiplicity of rods located perpendicularly to the material flow direction and parallel to the magnetic field direction, said rods producing the high magnetic gradients by being a combination of ferromagnetic and nonferromagnetic materials which produce distortions of the applied magnetic field. Another object of this invention is to provide a new and improved magnetic separator to continuously separate materials of different magnetic susceptibilities over a wider range of susceptibilities, and to achieve increasing separation of the materials as the length of the separator and the magnetic field are increased. Another object of this invention is to provide an apparatus of inexpensive construction. These and still further objects are discussed hereinafter and are particularly delineated in the appended claims. The foregoing objects are achieved in a magnetic separator or concentrator that receives a fluid stream or slurry containing materials of different magnetic susceptibilities and acts to separate the materials of different magnetic susceptibilities through a series of discrete steps of high magnetic field gradients so arranged that the fluid materials which are higher in susceptibility are attracted toward the discrete steps of high magnetic field gradients and are moved toward the outside source of the magnetic field and fluid materials which are much lower in susceptibility are moved toward the center of the fluid stream and away from the outside source of the magnetic field because of the increasing concentration of higher susceptibility materials. The separator or concentrator includes an elongate non magnetic outer housing that receives the fluid which flows axially through the housing and means for providing a substantially uniform magnetic field, which passes through the housing. A plurality of small diameter wires or rods, each one of which is a combination of ferromagnetic and non ferromagnetic materials, are disposed within the housing and oriented perpendicular to the axis of the housing (and hence to the flow direction of the fluid stream) and parallel to the lines of magnetic flux which are also perpendicular to the axis of the housing. Each rod, which is comprised of alternating sections of ferromagnetic and non ferromagnetic material or alternatively can be comprised of a nonferromagnetic material with discrete sections of the rod which are coated with a ferromagnetic material, or have sections of ferromagnetic materials attached, distorts the magnetic field in such a way that there are regions or lengths of the rod which have a high gradient magnetic field surrounding them and other regions which have a low gradient magnetic field surrounding them. Succeeding rods, located downstream in the fluid flow path have patterns of alternating sections of ferromagnetic and non ferromagnetic materials arranged in such a way as to produce channels of high gradient and low gradient magnetic fields which diverge outwardly toward the source of the magnetic field and also the walls of the housing. Alternately the rod patterns can be arranged so that the channels of high gradient and low gradient fields converge toward the center of the housing or the rod patterns can be arranged so that the high gradient channels go either direction and the low gradient fields go the opposite direction. The magnetic field strength, the field gradient, the number and spacing of rods, the pattern of ferromagnetic and non ferromagnetic materials on each rod, and the susceptibility of the material to be separated are so combined that the materials to be separated are diverted in the direction of the channels as they flow through the separation zone and are concentrated towards the walls of the housing or inwardly toward the center of the housing where nonmagnetic partitions are located to divert the flow into separate plenum streams. The magnetic field may be constant or may vary with time to produce the effect of releasing magnetic materials from the high field gradient area on one set or rods to move on to the next set of rods located downstream.

The frequency and the wave shape of the magnetic field can be synchronized with the velocity of the fluid.

The rod cross section can be circular or oval, or triangular, or square, or rectangular or other shape with the cross section small enough to provide the high magnetic field gradients needed to concentrate the magnetic materials but not so small that the effect upon the applied magnetic field is insubstantial.

BRIEF DESCRIPTION OF THE DRAWINGS

A preferred embodiment of the invention is hereinafter described with reference to the accompanying drawings in which.

DETAILED DESCRIPTION

Figure 1:
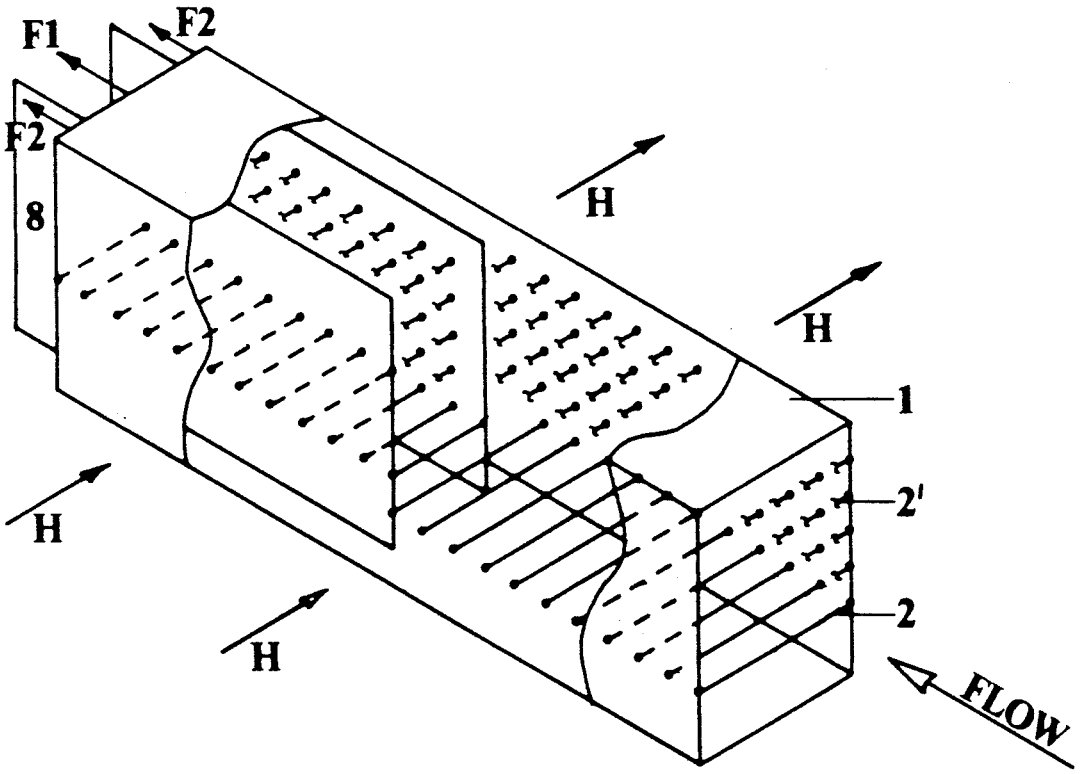
FIG. 1 is an isometric view of the elongate non magnetic outer housing, partially cut away, showing the arrangement of one row of rods, the fluid flow, one set of stream separating partitions, and the external magnetic field. The number of rods shown is greatly reduced for the sake of clarity.

Referring to FIG. 1, the fluid flows in the direction shown into the non magnetic outer housing 1 which allows the magnetic field to pass through to the rods, one row of which is shown complete 2 and other rows 2', which are partially illustrated for clarity. The spacing between rows and subsequent rods is exaggerated. In practice, the spacing of the rods is much closer.

Figure 2:
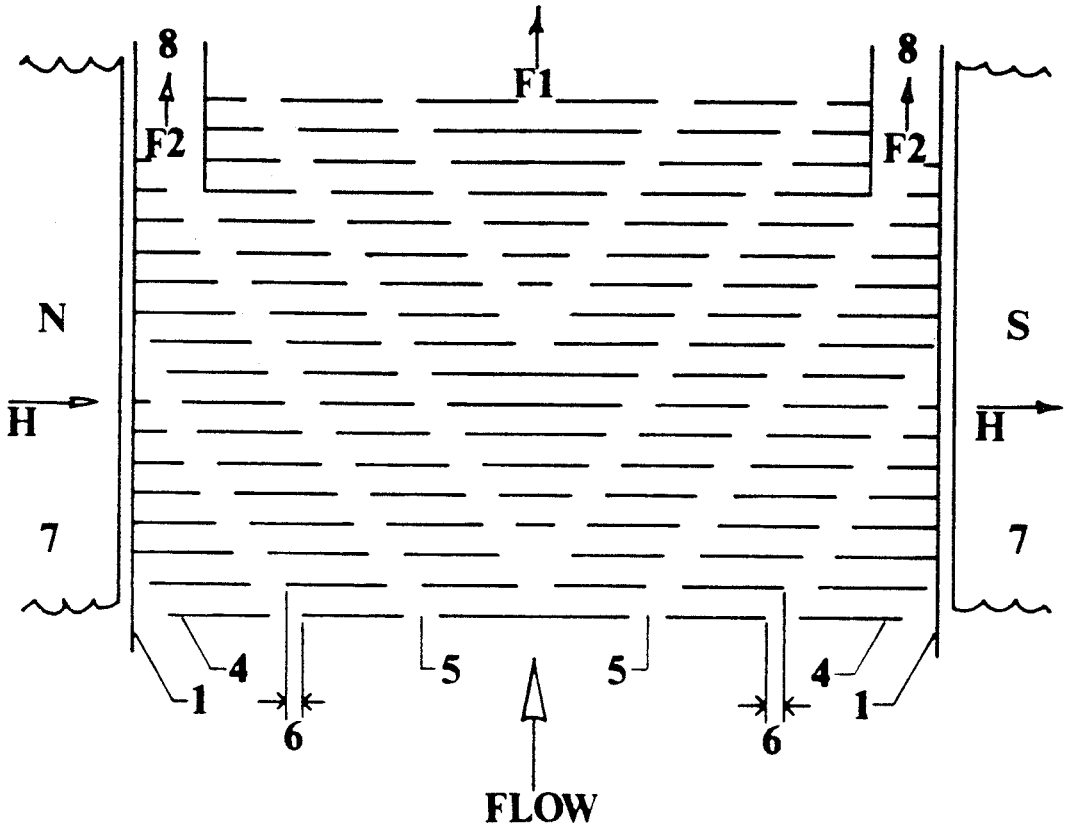
FIG. 2 is a plan view of one row of rods showing the spacing and offset of the ferromagnetic sections, offset toward the outer housing.

As the fluid passes around each rod it is subjected to a magnetic field gradient which is produced by the alternating sections of ferromagnetic material, which are coated on the non ferromagnetic rod in discrete areas. FIG. 2 is a plan view of one row of rods. For each rod which is perpendicular to the direction of flow, only the ferromagnetic coating 4, on each rod is shown. The blank spaces 5 of each rod are the non ferromagnetic sections of the rods. The pattern of subsequent ferromagnetic coatings in the direction of flow is offset 6 so that the downstream rods of each row tend to move materials which move in the direction of increasing magnetic strength toward the outside walls of the outer housing 1. This causes an increasing concentration of magnetic materials at the outside walls where a baffle opening 8 is provided on each side to mechanically separated flow streams F1 and F2. The housing 1 is located between the poles 7 of a magnet or electromagnet which produces a high intensity field.

Figure 3:
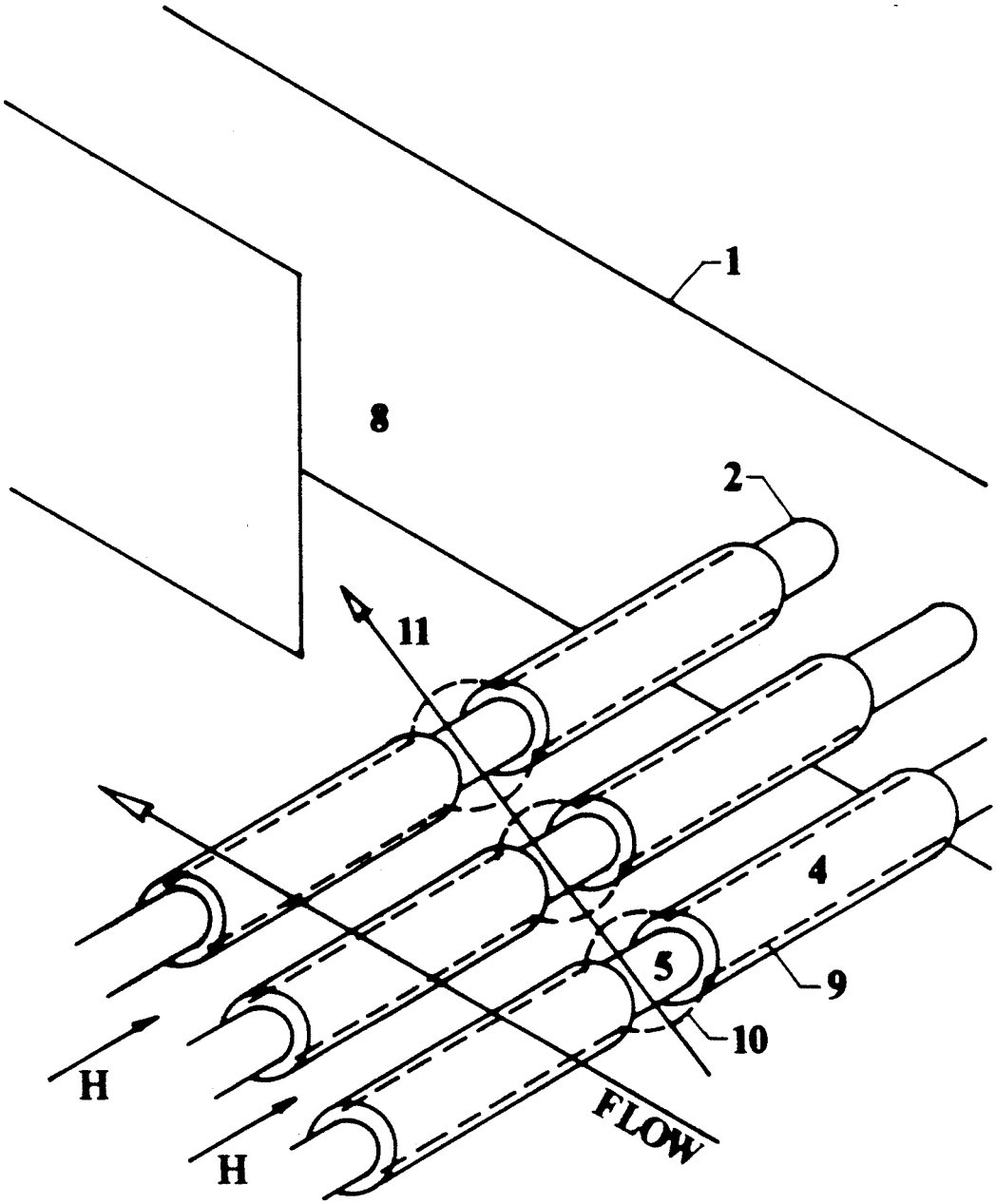
FIG. 3 is a greatly enlarged isometric view of 3 subsequent rods with the rod and field direction parallel and both perpendicular to the flow direction

FIG. 3 is an enlarged isometric view of portions of rods showing the ferromagnetic coatings 4 and the non ferromagnetic sections 5 on the first rod and also showing a portion of subsequent rods. The magnetic field gradient of the ferromagnetic sections are shown at 9 and magnetic field gradient 10 of the non ferromagnetic sections of the rods. The top is removed from the housing to show the baffle opening 8. The magnetic field gradients are highest where the magnetic field lines enter and leave each ferromagnetic section of rod. Materials with positive susceptibilities will experience a force which tends to move that material to the areas where the field gradients are highest and materials with negative susceptibilities will experience a force which tends to move that material to the areas of lowest field gradients where the magnetic field lines are inside the ferromagnetic coating on the rods. With the flow velocity high enough to not allow the magnetic material to attach itself to the rod, the magnetic materials with greater negative or positive susceptibilities will travel along path 11 toward the outside wall 1 of the housing and into baffle opening 8 and will displace the materials of lesser susceptibility away from the baffle opening 8.

Figure 4:
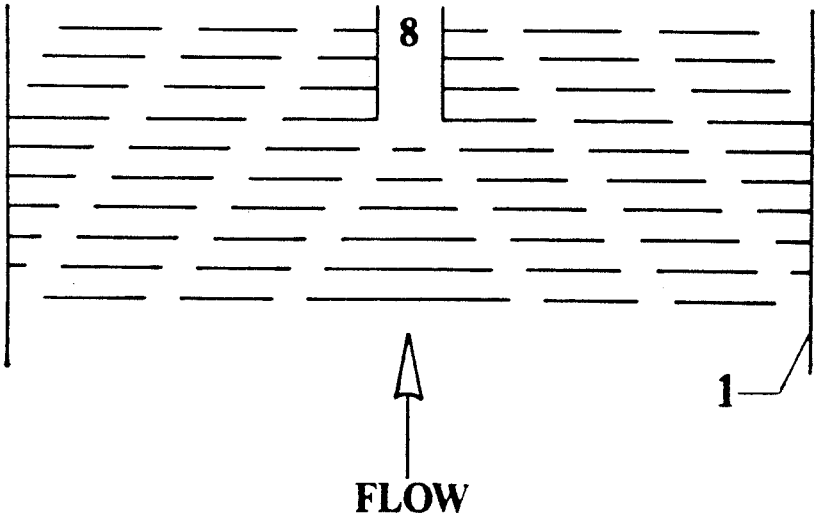
FIG. 4 is a plan view of one row of rods showing an alternate spacing and offset of the ferromagnetic sections, off-set away from the outer housing.

With the pattern of ferromagnetic and non ferromagnetic sections of rods as shown in FIG. 2, the materials of greater susceptibility will concentrate at the outer housing wall. If the pattern of rod sections were reversed as shown in FIG. 4, then the materials of greater susceptibility would concentrate in the center of the housing. Positive and negative susceptibilities are referenced to a vacuum. If materials are suspended in a fluid, then positive susceptibilities are those greater than the fluid susceptibility and negative susceptibilities are those less than the fluid susceptibility.

Figure 5:
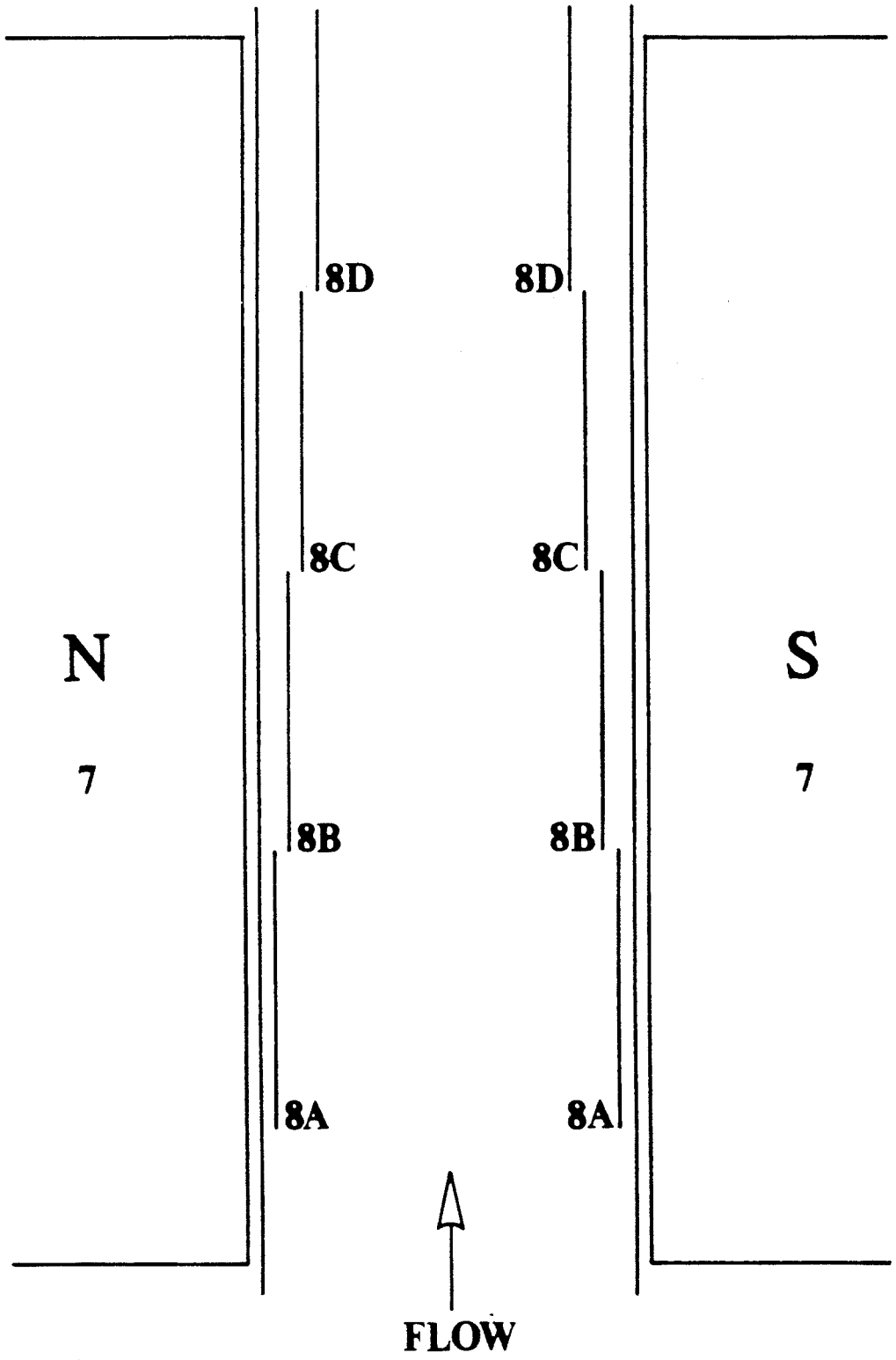
FIG. 5 is a plan view of the elongate outer housing, not showing the rods for the sake of clarity

The action of concentration and mechanical separation at the baffle opening 8 can be repeated along the length of the housing as shown in FIG. 5 where the rods are not shown. The magnetic material nearest to the outside wall 1 flows into the first baffle opening 8A Subsequent baffle openings 8B, 8C, 8D, etc. receive magnetic materials which were located successively closer to the longitudinal axis of the elongate housing.

This invention allows separation of materials of a wide range of susceptibilities and particle size. The combination of: a) field strength—determined by the strength of the poles 7 and spacing between poles; b) the field gradients produced by the ferromagnetic sections-determined by the thickness and type of ferromagnetic coating material on the non ferromagnetic rods, the diameter of the rods, the ratio of the surfaces area of the rods which are coated with ferromagnetic material to the surface area which is not coated, and the spacing between rods; c) the magnetic forces exerted upon the materials in a direction toward the separation baffle opening 8—determined by the amount of offset 6 between subsequent rows of rods; and d) the concentration of separated materials desired—determined by the spacing between subsequent baffle openings 8, the size of the baffle openings 8, the length of the separator and magnetic field, and the rate of flow of material into the separator housing 1, are so combined to match the susceptibility and particle size of each application. This allows separation of materials of a wide range of susceptibilities and particle size.

The most efficient operation of the separator is accomplished when the amount of ferromagnetic material on the rods contained between the magnetic poles, lowers the magnetic reluctance of the air gap in the separation region to an optimum point where the strongest field gradients possibile are produced throughout the volume of the separator, with the ferromagnetic material saturated at the ends of the ferromagnetic coatings. Saturation and strong field gradients are produced at the ends of the ferromagnetic coating on the rods. The ferromagnetic coating can be uniform in thickness or can be tapered or graduated in thickness. One method of fabrication of the sections of ferromagnetic coatings on the rods can be accomplished with techniques used in the fabrication of electronic circuits on semiconductors or "chips". A "resist" material or mask is applied and removed with great precision and allows precise placement of ferromagnetic coatings on non ferromagnetic materials.

Figure 7:
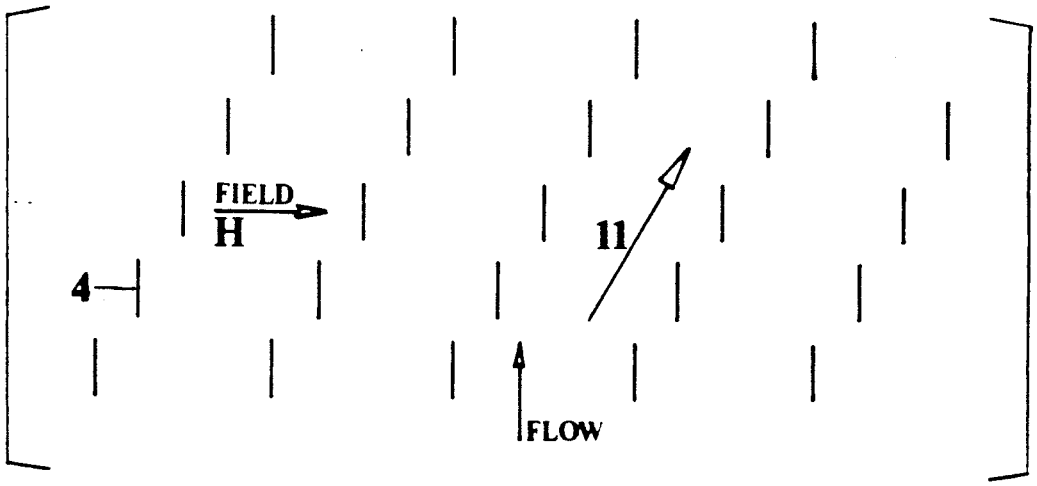
FIG. 7 is a plan view showing the ferromagnetic sections of the rods with the flow and rod direction parallel and both perpendicular to the field direction
Figure 8:
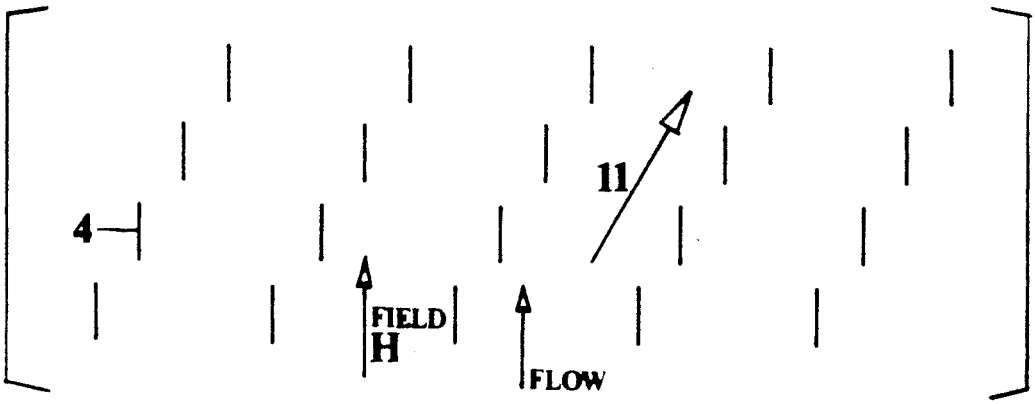
FIG. 8 is a plan view showing the ferromagnetic sections of the rods with the rod flow and field direction all parallel
Figure 9:
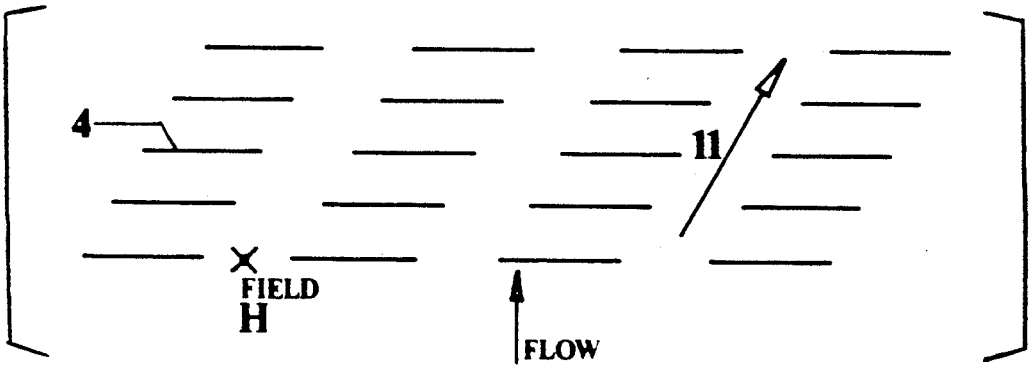
FIG. 9 is a plan view showing the ferromagnetic sections of the rod with the rod flow and field direction mutually perpendicular

The repetitive pattern of magnetic field gradients, which diverge or converge in the direction of flow, and produce separation of magnatic materials can be produced as in the preferred embodiment, FIG. 3 with the field direction and rod direction parallel and both perpendicular to the flow. Alternatively, the pattern can be produced with flow and field direction parallel, and both perpendicular to the rod direction FIG. 6, or flow and rod direction parallel, and both perpendicular to the field direction FIG. 7, or rod, flow, and field direction all parallel FIG. 8, or the rods, flow, and field direction mutually perpendicular FIG. 9

Figure 6:
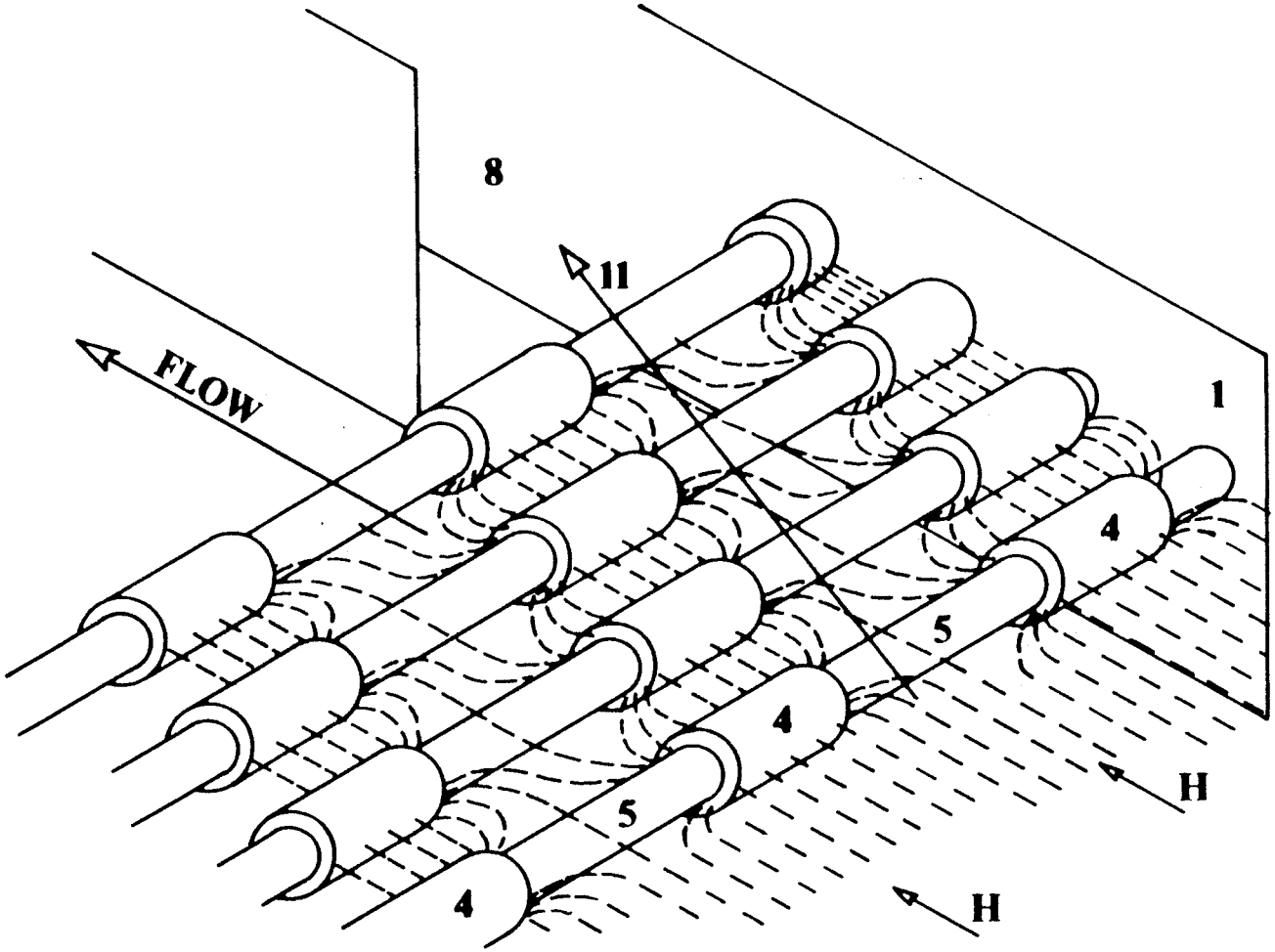
FIG. 6 is a greatly enlarged isometric view of 4 subsequent rods with the flow and field direction parallel and both perpendicular to the rod direction

FIG. 6 is an enlarged isometric of portions of rods showing the ferromagnetic coatings 4 and the non magnetic sections 5 on the first rod and also showing a portion of subsequent rods, with the flow direction and the field direction parallel and both perpendicular to the rod direction. The top is removed from the housing to show the baffle opening 8. The lines of magnetic flux in one plane are shown as dashed lines and show the high magnetic field gradients at the ferromagnetic sections 4 and the low magnetic field gradients at the non magnetic sections 5. Materials with positive susceptibilities will experience a force which tends to move that material to the areas of where the field gradients are highest and materials with negative susceptibilities will experience a force which tends to move that material to the areas of the lowest field gradients. With the flow velocity high enough to not allow the magnetic material to attach itself to the rods, the magnetic materials with greater susceptibilities will travel along path 11 toward the outside wall of the housing and into baffle opening 8. With the positive susceptibilities greater than the negative susceptibilities in a mixture of both materials, the positive susceptibility materials will concentrate toward the baffle openings and the negative susceptibility materials will concentrate toward the center of the elongate housing.

In all configurations of rod and flow and field directions, the sections of ferromagnetic material on the rods are so arranged as to produce channels of high gradient magnetic fields which diverge or converge in the direction of flow and thus produce a net relative movement perpendicular to the direction of flow. By arranging the pattern of magnetic and non magnetic sections of the rods, a 3 dimentional array of high gradient magnetic fields is produced in a non random repetitive pattern. The pattern changes in the direction of material flow, so that as the material progresses along the flow path the succeding high gradient magnetic fields exert forces on paramagnetic or ferromagnetic materials in the flow stream to move the paramagnetic or ferromagnetic materials in a direction which does not coincide with the flow direction but has a component which is perpendicular to the flow direction. This produces a migration of the paramagnetic or ferromagnetic materials towards either the center or to the outer sides of the housing which contains the flow of materials and thus produces an area within the flow path where the paramagnetic or ferromagnetic materials are concentrated and then diverted away from the main flow by a baffle partition or pair of baffle partitions which mechanically separates the magnetically enriched stream from the original stream. Succeeding baffles may be located along the flow direction so that succeeding areas of concentrations of paramagnetic or ferromagnetic materials may be separated from the main flow and allow increasing separation of the flow stream by increasing the length of the flow housing and magnetic field.

What is claimed is:

1. A magnetic separator having in combination a non-magnetic elongate outer housing to contain the flow of a fluid stream containing particles with a range of susceptibilities;

a pair of adjacently disposed axially oriented non magnetic partitions oriented substantially parallel to the elongate axis of the elongate outer housing in the separation region and having an open end in the separation region, subsequent pairs of partitions being located downstream in the flow direction and offset in the transverse direction from previous partitions, to collect high concentrations of the higher susceptibility particles;

a plurality of small cross sectional area rods comprised of alternating sections of nonmagnetic and ferromagnetic materials, said sections of said rods arranged in a, non random, regular pattern; said rods oriented to produce along the elongate axis of the elongate outer housings in the separation region, a pattern of high gradient magnetic fields which form channels which move the higher susceptibility particles along the direction of fluid stream flow and toward the openings formed by the non magnetic partitions; means for creating in said separation region a substantially uniform applied magnetic field, said applied magnetic field being in a direction to produce along each rod, regions of high and low magnetic gradients, because of the distortion of the magnetic field by the said ferromagnetic materials, said magnetic gradients forming a three dimensional array which form magnetic channels of high gradient fields which move the higher susceptibility particles toward the openings formed by the non-magnetic partitions.

2. A magnetic separator as claimed in 1 wherein the magnetic field direction and rod direction are parallel and both are perpendicular to the flow direction.

3. A magnetic separator as claimed in 1 wherein the flow direction and magnetic field direction are parallel and both are perpendicular to the rod direction.

4. A magnetic separator as claimed in 1 wherein the flow direction and rod direction are parallel and both are perpendicular to the magnetic field direction.

5. A magnetic separator as claimed in 1 wherein the rod direction, flow direction, and magnetic field direction are all parallel.

6. A magnetic separator as claimed in 1 wherein the rod direction, flow direction and magnetic field direction are all mutually perpendicular.

7. A magnetic separator as claimed in 1 wherein the rods are comprised of non-magnetic materials with sections of said rods coated with ferromagnetic materials.

8. A magnetic separator as claimed in 1 wherein the rods are comprised of non-magnetic materials with sections of said rods having ferromagnetic materials attached.

9. A magnetic separator as claimed in 1 wherein the rods are comprised of alternating sections of non-magnetic and ferromagnetic materials.

10. A magnetic separator as claimed in 1 having many rods with a cross section of any shape and small enough to provide the high magnetic field gradients needed to concentrate the magnetic particles but not so small that the effect thereof upon the applied magnetic field is insubstantial.

11. A separator as claimed in 1 wherein the means for creating a magnetic field is operable to create a field that varies in intensity.

12. A magnetic concentrator that receives a slurry as a continuous flow fluid stream containing magnetic or magnetizable particles and non-magnetic particles and that acts to concentrate the magnetic or magnetizable particles at pairs of transversely opposed non-magnetic partitions, said magnetic concentration comprising in combination:

(a) concentrating means comprising a plurality of small cross sectional area, non-magnetic rods comprised of alternating sections of ferromagnetic materials disposed in a separation region, wherein means to provide a magnetic field are provided, said sections of ferromagnetic materials arranged in a pattern to produce high gradient magnetic fields which exert forces on the magnetic particles, said forces in combination with the flow force of the fluid stream move the magnetic particles along a path toward the closest high gradient magnetic field and then in a direction to divert the flow path to the next closest high gradient magnetic field and then to subsequent next closest high gradient magnetic filed regions, said next closest regions of high gradient magnetic fields forming a 3 dimensional pattern which concentrates the magnetic particles in certain regions and depletes them from other regions of the flow stream;

(b) baffled structure means comprising pairs of open-ended, transversely-spaced channels located along the flow path forming baffle openings in the said certain regions of high magnetic particle concentrations and (c) plenum means connected to receive the contents of the channels which contain slurry with a high proportion of magnetic particles and to exhaust the contents to an output displaced from the fluid flow stream.

13. A magnetic separator as claimed in 12 wherein the magnetic field direction and rod direction are parallel and both are perpendicular to the flow direction.

14. A magnetic separator as claimed in 12 wherein the flow direction and magnetic field direction are parallel and both are perpendicular to the rod direction.

15. A magnetic separator as claimed in 12 wherein the flow direction and rod direction are parallel and both are perpendicular to the magnetic field direction.

16. A magnetic separator as claimed in 12 wherein the rod direction, flow direction, and magnetic field direction are all parallel.

17. A magnetic separator as claimed in 12 wherein the rod direction, flow direction and magnetic field direction are all mutually perpendicular.

18. A magnetic separator that receives a fluid stream comprising a mixture of gases of positive susceptibility and negative susceptibility with the positive susceptibility greater than the negative susceptibility and acts to concentrate the gases of positive susceptibility at pairs of transversely spaced regions of the stream that comprises; a non-magnetic outer housing to receive the fluid stream which flows through the housing in the longitudinal direction; a plurality of small cross sectional area rods located within the housing, comprised of non-magnetic materials with alternating sections of ferromagnetic materials on said rods oriented to produce magnetic channels of high gradient fields, said high gradient field channels produced by the ferromagnetic materials distortion of a high strength magnetic field and the position of the ferromagnetic materials in the three dimentional space within the housing, said magnetic channels diverting away from the flow path toward said pairs of transversely spaced regions and exerting forces on the positive susceptibility gases to move them toward the pairs of transversely spaced regions; means providing a high strength magnetic field in the space occupied by the rods; and baffled openings located at the transversely spaced regions where the positive susceptibility gases concentrate, and which divert the flow of said gases away from the main fluid stream flow.

19. A magnetic separator as claimed in 18 wherein the magnetic field direction and rod direction are parallel and both are perpendicular to the flow direction.

20. A magnetic separator as claimed in 18 wherein the flow direction and magnetic field direction are parallel and both are perpendicular to the rod direction.

21. A magnetic separator as claimed in 18 wherein the flow direction and rod direction are parallel and both are perpendicular to the magnetic field direction.

22. A magnetic separator as claimed in 18 wherein the rod direction, flow direction, and magnetic field direction are all parallel.

23. A magnetic separator as claimed in 18 wherein the rod direction, flow direction and magnetic field direction are all mutually perpendicular.

* * * * *